US006119458A

United States Patent [19]

Harris et al.

[11] Patent Number: 6,119,458

[45] Date of Patent: Sep. 19, 2000

[54] IMMISCIBLE, DIRECT CONTACT, FLOATING BED ENHANCED, LIQUID/ LIQUID HEAT TRANSFER PROCESS

[76] Inventors: James Jeffrey Harris, 2592 Westridge Dr., Cameron Park, Calif. 95682; James William Harris, 14080 Berry Rd., Golden, Colo. 80401

[21] Appl. No.: 09/222,542

[22] Filed: Dec. 29, 1998

[51] Int. Cl.[7] ..... F01K 25/06

[52] U.S. Cl. ..... 60/649; 60/673

[58] Field of Search ..... 60/649, 641, 645, 60/673; 165/104.16, 111, 114

[56] References Cited

U.S. PATENT DOCUMENTS

| | | | |
|---|---|---|---|
| 1,905,185 | 4/1933 | Morris . | |
| 3,164,957 | 1/1965 | Fricke | 60/36 |
| 3,741,289 | 6/1973 | Moore | 165/32 |
| 3,821,089 | 6/1974 | Hickman | 203/10 |
| 3,830,075 | 8/1974 | Cheng et al. | 62/54 |
| 3,988,895 | 11/1976 | Sheinbaum | 60/641 |
| 3,989,467 | 11/1976 | Paige | 23/267 |
| 4,063,419 | 12/1977 | Garrett | 60/641 |
| 4,089,175 | 5/1978 | Woinsky | 60/644 |
| 4,120,158 | 10/1978 | Sheinbaum | 60/641 |
| 4,167,099 | 9/1979 | Wahl, III | 60/641 |
| 4,192,144 | 3/1980 | Pierce | 60/641 |
| 4,272,960 | 6/1981 | Wahl, III | 60/641 F |
| 4,458,747 | 7/1984 | Berry et al. | 165/104.29 |
| 4,554,963 | 11/1985 | Goodwin et al. | 165/104.16 X |
| 4,616,698 | 10/1986 | Klaren | 165/104.16 |
| 4,776,388 | 10/1988 | Newby | 165/104.16 X |
| 5,141,047 | 8/1992 | Geoffroy | 165/104.16 |

*Primary Examiner*—Hoang Nguyen
*Attorney, Agent, or Firm*—Edwin H. Crabtree; Ramon L. Pizarro; Donald W. Margolis

[57] ABSTRACT

A heat transfer process for a liquid (5) using counterflow, direct contact with another, immiscible fluid (1), of differing temperature and density, in the presence of a free floating media bed (7). Heat transfer within the liquid (5) occurring as a consequence of direct contact with the immiscible fluid (1) of differing temperature. The counterflow motion a consequence of buoyancy forces resulting from the different densities of the liquid (5) and immiscible fluid (1). The media bed (7) being of a nature preferentially wetted by the immiscible fluid (1), thereby providing a large film type surface area of the immiscible fluid (1) for direct contact heat transfer with the liquid (5). The free floating nature of the media bed (7) resulting from the materials comprising the media being of a density intermediate between that of the liquid (5) and that of the immiscible fluid (1). The free floating media bed (7) being by nature nonplugging and providing enhanced direct contact heat transfer by the extended fluid film surfaces confined therein.

18 Claims, 1 Drawing Sheet

Figure 1:
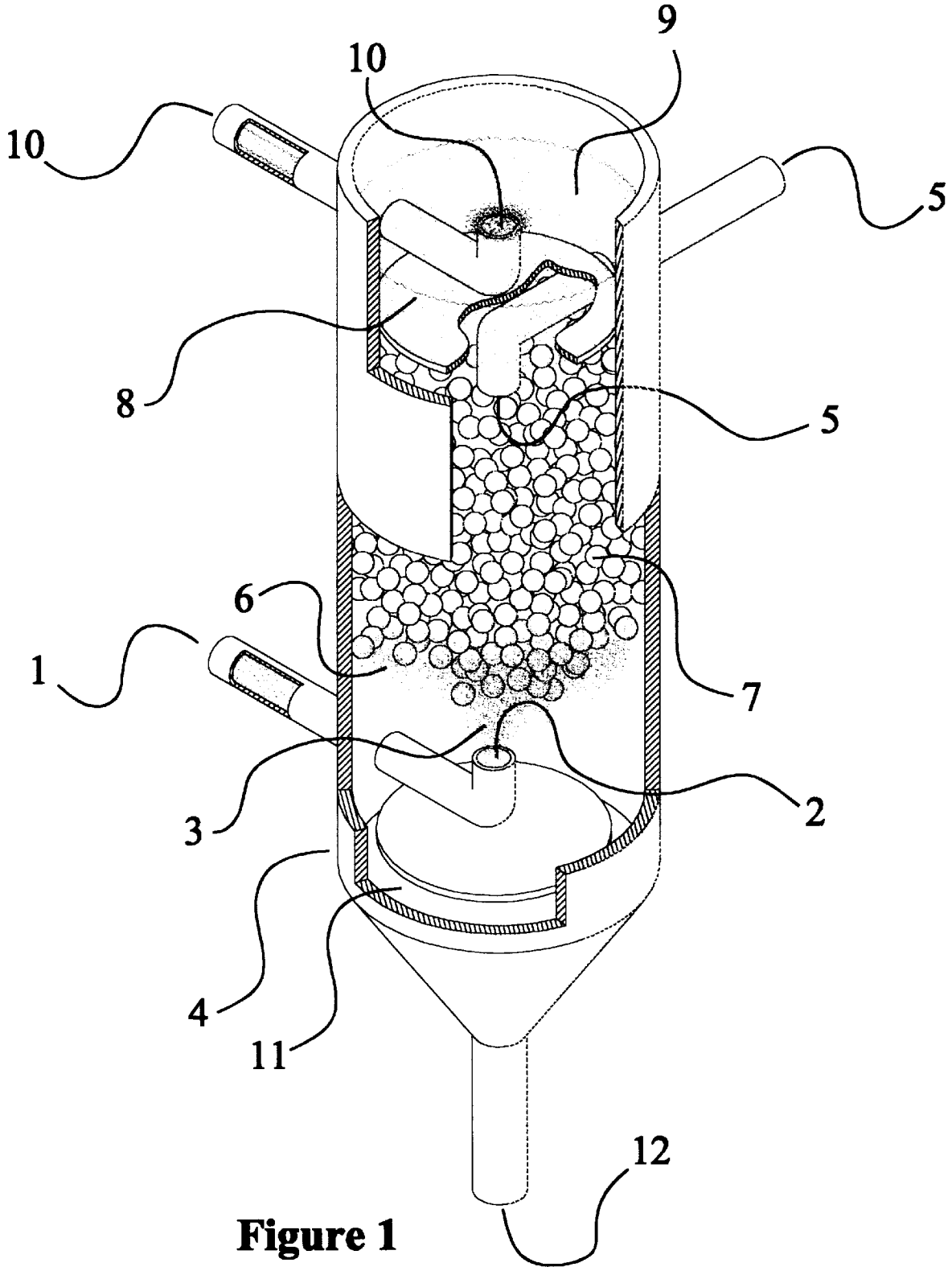

IMMISCIBLE, DIRECT CONTACT, FLOATING BED ENHANCED, LIQUID/ LIQUID HEAT TRANSFER PROCESS

BACKGROUND

1. Field of Invention

This invention relates to a heat transfer process for the heating or cooling of a fluid by means of direct contact with an intermediary, immiscible liquid enhanced by the presence of a semi-buoyant, surface active media bed.

2. Description of Prior Art

Heat transfer processes have been an essential component of human activity since prehistory. The first heat transfer process utilized by mankind was in the use of sunlight for body warmth. With the development of controlled fire, heat; transferred from an open fire, was used to cook food which presented a more palatable and hygienic food format. To prevent the charring associated with cooking over open fires, hot rocks taken from open fires, were eventually utilized to provide cooking surfaces and heat sources for better controlled cooking. Today, heat transfer processes are employed in all phases of human activity. Examples of such are cooking, space heating and cooling, fabrication, warfare, transportation, generation of light, preservation of food, medicinal care, chemical conversion processes, to name only a few.

There are three basic modes of heat transfer. These modes are radiative, convective and conductive. All heat transfer applications employ one or more of these modes.

Radiative heat transfer occurs as electromagnetic energy emitted from a thermal source, is absorbed by a thermal sink. This energy induces molecular vibration in the absorbing matter, which is observed as heat. Radiative heat transfer is the only heat transfer mode in which heat can be transferred from a thermal source to a thermal sink across open space. Heat transfer through radiation was illustrated in the foregoing paragraph as the use of sunlight to warm and thereby transfer heat to the body. The emitting thermal source being the Sun and the absorbing thermal sink being the body.

Convective heat transfer is a mode in which matter, heated from a thermal source, physically transports (convects) heat from the thermal source to a thermal sink. Typically this convecting matter is a gas, liquid or plasma (referred hereafter as a fluid). Convective heat transfer incorporates three steps. The first step entails direct contact heating of a convecting fluid by a thermal source. The second step involves the transport of the heated convecting fluid away from the thermal source. The third step occurs when heat is transferred from the transported convecting fluid into a thermal sink by means of direct contact between the two. Convective heat transfer was exemplified in the foregoing examples as the use of open fire to cook food. In that example, gases, as the convecting fluid, were heated by direct contact with the fire, rose and carried (convected) heat away from the fire. Cooking ensued as a result of direct contact between the food and these convecting gases.

The third heat transfer mode is conduction. Conduction is the process whereby heat is transferred internal to or between two or more contacting matter bodies. Essentially Conduction is the mechanical equalization process of molecular vibratory energy in or between contacting matter.

If a matter body is heated unevenly so as to induce uneven temperatures within the body, and if the matter body cannot support internal fluidized convection or internal cavity radiative transfer then heat will naturally transfer by means of conduction from warmer to cooler sections of the body. This effect is governed by the geometry of the matter body, temperature gradients within the matter body and the thermal conductivity (a physical property) of the material comprising the body.

If two or more matter bodies of differing temperatures are brought into direct contact with each other, heat will be transferred by means of conduction from the warmer into the cooler of the bodies. This effect is governed by the geometry of both the contacting matter bodies and the contacting surfaces, temperature gradients within the bodies, the temperature differential between the bodies and the thermal conductivity of the materials comprising the matter bodies. Heat transfer by means of conduction was illustrated in the foregoing examples as the use of hot rocks to provide heat for cooking. By means of conduction, heat is transferred from the interior to the surface of the rock where it is used for cooking.

All three heat transfer modes are currently employed in industry with conductive and convective processes being predominant. Transference of heat using both convective and conductive modes is common. In a typical application, heat is transferred from a thermal source, through the walls of a tube and into a liquid contained within the tube. The transference of heat from the thermal source to the exterior surface of the tube is generally a convective process. The transference of heat from the exterior surface through the tubing wall to the interior tubing wall surface is a conductive process. The transference of heat from the interior tubing surface to the liquid is generally a convective process. One objective of such an application would be to alter the chemical, thermodynamic or phase conditions of the liquid. An example of such an application would be the heating of water for a phase conversion to steam. Another objective would be to heat and employ this liquid as a heat transfer medium. In such an application the heated liquid would be transported by means of the tubing to a remote location where the entrained heat is either discharged or employed for process. An example of such an application would be electric power plant cooling in which circulating water transports heat from a steam condenser to a cooling tower or radiator for environmental discharge.

Conductive heat transfer processes in which heat is transferred across a solid wall, as discussed above, are common. In such applications the solid wall provides both the medium for heat conduction as well as for mechanical separation of the materials or events on opposite sides of the wall. Heat conduction through the solid wall is controlled by the thermal conductivity of the material of the wall, the temperature difference across the wall and the thickness of the wall. Wall material with low thermal conductivity and/or excess thickness impedes heat transfer. Wall material with high thermal conductivity and/or thinness enhances heat transfer.

Conductive heat transfer through layered walls is controlled by the relative thickness and thermal conductivity of the materials comprising the layers. Heat is transferred through the layers in series. As a result of this series configuration, heat transfer is governed by the least conductive of the layers. A layer comprised of material of low thermal conductivity can substantially reduce heat transfer rates through the wall.

Many liquids when heated (or cooled) experience chemical or physical changes which result in the precipitation or formation of solids. These solids can accumulate on surfaces which are in contact with the liquid. Heat transfer into (or out of) such a liquid by means of direct contact between the liquid and a heated (or cooled) wall surface usually results in the accumulation of solids on the heated (or cooled) wall surface. The buildup of such precipitates and solids on the wall generates a layer through which heat must be transferred to heat (or cool) the liquid. The precipitates and solids comprising this layer generally have low thermal conductivity. This layer impedes heat transfer. Heat transfer rates through the wall and into (or out of) the liquid can be reduced to unacceptable levels as the layer deposits and thickens. In the parlance of the heat exchange equipment industry, this accumulation process and the resulting negative effects are referred to as scaling or fouling of the heat exchanger or heat exchange surfaces.

Scaling and fouling impair heat transfer because of the buildup of thermally resistant materials on the heat transfer wall surfaces. In contrast, corrosion and chemical attack thins, pits, cracks and generally reduces the mechanical integrity of heat transfer walls. This problem manifests itself not in the imposition of heat transfer but rather in reduction of the service life of heat transfer equipment. Corrosion and chemical attack are generally provoked by incompatibility between the fluid being heated or cooled and the materials of construction of the heat transfer equipment. Such attack can also be incited by chemical additives intended for the reduction of scaling and fouling. Typically, problems associated with corrosion and chemical attack of heat transfer equipment are resolved through the use of different materials of construction and/or chemical treatment of the fluid to buffer the offending chemistry.

Scaling and fouling of heat exchange surfaces is a prevalent problem of industry. In many industries the labor and costs associated with mechanical and/or chemical cleaning of heat exchangers to remove scale and fouling represents a formidable financial burden. Various methods have been employed to minimize fouling and scaling of solid wall heat exchangers. Chemical additives to modify pH, surface tension characteristics or other chemical parameters are sometimes used to reduce precipitation or other depositional tendencies of the liquid.

Another method has been the incorporation of self cleaning mechanisms to continually or periodically scrape or abrade fouling and/or scaling materials from heat transfer surfaces. This method, generally known as a scraped wall heat exchanger, is often used for those circumstances where the scale or fouling material is valuable and is the desired end product of the heat transfer process. A related method with the additional advantage of providing convection enhancing turbulence is described in U.S. Pat. No. 4,616,698, granted to Klaren. This method incorporates a fluidized granular mass suspended in a liquid undergoing heat transfer. This granular material contacts the heat exchange solid walls, abrades deposits and generates turbulence within the liquid.

A third common method, particularly in those applications for which the liquid is circulated for the transport of heat, is discharge (blowdown) of the fouling liquids and recharge (makeup) with less fouling or fresh liquid. The blowdown carries some of the fouling materials away from the heat transfer process. The makeup then dilutes the remaining liquid to maintain the fouling and scaling materials in solution and reduce their tendency toward deposition.

Direct contact, immiscible, liquid to liquid heat transfer has been postulated and seen some limited applications. This process is advantageous in that there are no solid walls through which heat is transferred. The lack of such walls eliminates the possibility of fouling, scaling or corrosion of heat transfer surfaces and thereby assures efficient heat transfer and acceptable equipment life. The prior art focus of direct contact immiscible, liquid to liquid heat transfer has been to transfer heat from fouling, hot brines into immiscible fluids, generally liquid hydrocarbons, which show little affinity for water. As examples, of such applications the reader is referred to U.S. Pat. No. 4,167,099, entitled Countercurrent Direct Contact Heat Exchange Process and System in which the inventors Wahl and Boucher describe a direct contact heat exchange process using a plurality of stages to contact a working fluid, such as a hydrocarbon with hot geothermal brines. Another similar patent, granted to Sheinbaum, reference U.S. Pat. No. 3,988,895 discloses a power generation process whereby a working fluid such as isobutene is heated through direct contact with a hot brine. U.S. Pat. No. 4,089,175, granted to Woinsky describes a similar process with the significant difference of specifying that the direct contact heat transfer process occur within the confines of a contacting tower maintained at a pressure equal to or in excess of the critical pressure of the working fluid. pentane is introduced as a supercooled fluid into direct contact with a heated fouling and scaling prone liquid brine. Other related patents are U.S. Pat. No. 1,905,185, granted to Morris and U.S. Pat. No. 3,164,957 granted to Fricke. The direct contact heat exchangers of prior art, as discussed in the foregoing, employ contacting vessels containing solid, essentially immobile sieves, trays or packing.

In the prior art, a typical application uses isobutane as the working fluid. Isobutane being less dense than the brine, rises through the brine and is heated by means of direct contact with the hot brine. As the isobutane is heated it changes phase to a vapor. This vapor exits from the top surface of the brine and is passed through demisting equipment and utilized to extract work by means of a Rankine (or other) thermodynamic cycle or employed for process heating.

A less common technique for heat transfer with scaling, fouling or corrosive liquids is by means of non-solid wall convective and radiative heat transfer processes. An example of a convective process is direct contact heating of a liquid by bubbling hot gases through it. This process, referred to as submerged combustion, has seen some limited use. A related process, in which superheated steam is injected into an aqueous based liquid is also used.

Another technique for the heating of scaling, fouling or corrosive liquids is by means of radiative heating. This technique has been used for the heating of liquids amenable to radiative absorption. A familiar example of such is the use of microwaves for the heating of aqueous based liquids.

Heating (or cooling) of fouling, scaling or corrosive liquids currently and historically has presented serious and expensive difficulties. Present solutions to reduce these problems suffer from several disadvantages:

(a) Resolution of corrosion problems through the use of more compatible materials of construction is generally burdened by the high cost and/or low thermal performance of such materials.

(b) Chemical buffering of corrosive liquids often is employed. However, cost and undesirable contamination of the liquid being heated or cooled frequently renders this approach unacceptable.

(c) Chemical treatment to reduce the fouling and scaling tendencies can be quite expensive. Many of the required chemicals are somewhat exotic and must be tailored to the specific liquid application. Often these chemical costs are excessive and a substantial financial burden to the user.

(d) Chemical treatment must be tailored to specific liquids. Often the efficacy of the treatment is dependent upon specific liquid constituents, pH, temperature or other characteristics, which may vary. The occurrence of such variance often reduces or impedes the effectiveness of the chemical treatment. This can result in fouling, scaling and consequential damage and/or expense.

(e) Chemical treatment can generally only provide limited protection. Often chemical treatment is used only to extend operating times between cleaning. Cleaning operations are still required to maintain the heat transfer efficiency.

(f) Chemical treatment often requires the use of harsh chemicals with high tendencies for corrosion or other damaging processes of metallic heat transfer surfaces. To mitigate the effects of these tendencies, heat transfer surfaces must often be manufactured of exotic, expensive and often difficult to fabricate materials. These corrosion resistant materials often present a compromise over ideal heat exchange material which would comprised of a material chosen for thermal conductivity rather than corrosion resistance. This compromise reduces the efficiency of the heat transfer process and necessitates the application of larger, more expensive heat exchangers.

(g) Often liquid discharge (blowdown) and fresh recharge (makeup) are concurrent with chemical treatment. In such cases the chemical treatment is employed primarily to minimize required discharge and recharge volumes. The discharge liquids often contain residues of the chemical additives. These residues can be hazardous, rendering the discharge volumes difficult to treat, handle or discard.

(h) Mechanical self cleaning (scraped wall) and granular abrading heat exchangers are expensive, often complicated and susceptible to mechanical failure.

(i) As a result of scraping and abrasion, the composition of the heat transfer surfaces incorporated in scraped wall heat exchangers must be hard and/or relatively thick. Often the required composition is exotic and expensive. Additionally, the composition is often a compromise over ideal heat exchange wall material which would be thin and comprised of a material chosen for thermal conductivity rather than abrasion resistance. This compromise reduces the efficiency of the heat transfer process and necessitates the application of larger, more expensive heat exchangers.

(j) Control of scaling and fouling by means of fouling liquid discharge and fresh liquid recharge often presents difficulties relative to the handling, treatment or disposal of the fouling liquids. Discharge treatment costs, environmental considerations and recharge liquid costs are inherent problems to this approach.

(k) Control of scaling and fouling by means of fouling liquid discharge and fresh liquid recharge require monitoring of the liquid properties to maintain the proper discharge and recharge rates. Excursions from this control can result in excess costs and liabilities if the rates are too high and fouling, scaling and potential damage if the rates are too low.

(l) Direct contact, immiscible fluid to liquid heat exchangers demonstrate limited efficiencies as a result of affinity and agglomeration of the direct contacting fluids. Typically, the immiscible fluid is dispersed as droplets into the scaling and fouling prone liquid. Droplet heat transfer rate is dependent upon the surface area of the droplet and the thermal gradient surrounding the droplet.

Surface tension effects result in droplets which are generally spherical in shape. The surface area to volume ratio of a sphere is 1/r, where r is the spherical radius. As a result of this inverse proportionality, larger drops in a dispersed volume generate smaller surface areas. Heat transfer from (or into) the dispersed droplets is regulated by the surface area of the droplets. Because of the affinity of like fluids, the dispersed droplets agglomerate as they pass through the scaling and fouling prone liquid. This agglomeration effect increases the size of the droplets which reduces the dispersed surface area and, as a result, the heat transfer rate.

Heat transfers from hot to cold. The impetus for this transfer is the temperature differential or more precisely the temperature (thermal) gradient perpendicular to the surface of transfer. The rate of heat transfer through any given surface is regulated not only by the area of the surface but also the temperature (thermal) gradient present at the surface. Heat transfer rates into or out of the surface of a droplet are regulated by the thermal gradient present at the surface. The thermal gradients affecting a droplet are controlled by the temperature difference between the droplet surface and the surrounding liquid, and the radius of the droplet. For a spherical surface, the thermal gradient is inversely proportional to the spherical radius. As the spherical droplets agglomerate and increase in size, the thermal gradients are reduced and the impetus for heat transfer diminishes. The consequence is also a reduction in heat transfer rates as the droplets agglomerate and increase in size.

The natural agglomeration of the dispersed droplets in a direct contact, immiscible fluid to liquid heat exchange process results in reduced heat transfer rates with the resulting loss of overall process efficiency. Dispersion plates and trays have been employed in an attempt to breakup the agglomerating droplets but have proven to be troublesome due to plugging, fouling and scaling of the plate and tray surfaces. Direct contact, immiscible, fluid to liquid heat exchange processes have demonstrated few applications because of these inefficiencies.

(m) Direct contact submerged flame type heat exchangers are capital intensive and require considerable energy to bubble the hot gases through the liquid to be heated. The hot gas is typically placed into the lower end of a liquid contacting column and is released to bubble upward, in direct contact, through the liquid column. The heat transfer occurs as the bubbles rise.

To permit adequate heat transfer, it is necessary to provide sufficient direct contact time between the hot gas bubbles and the liquid. The upward velocity of the bubbles is generally high, therefore the contacting column must be tall to insure sufficient contacting time for heat transfer. The hot gas is injected into the bottom of the liquid column. For injection to occur, the hot gas pressure must be in excess of the hydrostatic pressure of the column.

The thermal energy content of a heated gas bubble rising through the liquid is small. For adequate heat transfer, plentiful volumes of hot gas must be contacted with the liquid. The high volume, high pressure and compressibility of the hot gas exacts a large measure of operating energy and expense for the direct contact, submerged flame heat transfer process.

(n) Direct contact submerged flame type heat exchangers generally require pollution control equipment such as drift and/or mist eliminators. This equipment can be expensive and troublesome. Submerged flame combustion vapor products exhaust aggressively from the top of the heated fluid. Carryover of liquid and particulates in this exhaust stream are difficult to control. Plugging and cleaning maintenance of the pollution control equipment as well as environmental liabilities are significant problems with direct contact submerged flame heat exchangers.

(o) Submerged flame type heat exchangers generally must use high grade heat such as that generated through the combustion of fuel. The low thermal conductivity of the bubbling gas inhibits the heat transfer rate into the liquid. The heat transfer impetus is the temperature differential between the bubble and the surrounding liquid. Bubbles comprised of high temperature gas are preferable to offset the low thermal conductivity effect. The exhaust or flue gas resulting from combustion of fuel is typically used for the bubbles because of the associated high temperature. This process is both expensive, since high grade heat in the form of fuel combustion is employed, and prone to contamination of the heated liquid with combustion byproducts.

(p) Submerged combustion processes are difficult to maintain if particulates are forming in the heat exchange process. The gas bubbles rising through the liquid generate high turbulence which inhibits settling of particulates. The particulates remain entrained in the liquid. For removal of the particulates the submerged flame process is terminated long enough for the particulates to settle. The settled solids are removed and the submerged flame process reinstated. The time required for the settling and solids removal operation varies with application but is always a burden on the process.

(q) Direct contact heating by means of steam injection is applicable only under those circumstances for which contamination by the steam condensate is acceptable. Such applications are generally limited to those examples where the heated liquid is aqueous based and open processes where the steam condensate or the mixture of condensate and heated liquid is discharged for disposal or other use.

(r) Radiative heating has found limited application because of capital and operational expense, liquid radiative absorption characteristics and energy inefficiency. Radiative heating requires that the liquid being heated absorbs the radiated energy. Often the liquid to be heated is transparent and radiative heating of the liquid is not possible.

The source of radiation is a high temperature thermal source as is generated by electric element resistance heating, fuel combustion or electromagnetic generation. All of these processes generate wasted heat which is convected or conducted away from the process and lost. Liquids which can absorb radiative energy for heat transfer generally do so over a limited wavelength band. Radiation outside of the limits of this band is not used and is wasted.

(s) Microwave heating of aqueous based liquids is a common place occurrence in many households and commercial eating establishments. This process works well for heating on a relatively small scale and where energy efficiency is not a concern.

OBJECTS AND ADVANTAGES

This invention relates to a process whereby heat is transferred into (or out of) a liquid through the use of an intermediary, immiscible, heat transfer fluid and a free floating, semi-buoyant, mobile bed of surface active media. The advantages of the invention result primarily from the ability to heat or cool liquids efficiently without the risk of corrosion, plugging, scaling and/or fouling and related equipment damage or thermal efficiency degradation.

The capability of the invention to transfer heat into (or out of) a liquid, especially those with plugging, fouling, scaling and/or corrosive tendencies provides several objects and advantages over the prior art. Some of which are as follows:

(a) The invention employs direct contact heat transfer between the immiscible heat transfer fluid and the liquid being heated or cooled. Solid heat transfer walls prone to corrosion are not present. Expense, weight and fabrication difficulties associated with corrosion resistant materials of construction are eliminated.

(b) The invention employs direct contact heat transfer between the immiscible heat transfer fluid and the liquid being heated or cooled. Solid heat transfer walls prone to corrosion are not present. Chemical buffering for protection from corrosive liquids being heated or cooled is not necessary since there are no corrosion susceptible materials present.

(c) The ability of the invention to efficiently transfer heat in the presence of and during the formation of precipitates and solids eliminates the need to employ chemicals to inhibit or control precipitates and solids formation. The elimination of chemical treatment costs is advantageous and may render an otherwise financially unacceptable heat transfer application possible.

(d) The invention is not susceptible to scaling and fouling. Variations of liquid constituents and associated changes in fouling and scaling characteristics does not effect the heat transfer efficiency of the invention. Since the invention does not require chemical treatment to control scaling and fouling, the expenses and difficulties associated with monitoring the liquid characteristics to maintain chemical treatment efficacy are eliminated.

(e) The nonscaling and nonfouling characteristics of the invention will maintain heat transfer efficiency continuously. The invention has no requirements for occasional cleaning and/or descaling. Maintenance downtime, associated expenses and operational losses are eliminated.

(f) Operation of the invention is not impaired by the presence of precipitating and accumulating solids. Chemicals which would normally be used to control such precipitation are not necessary. Consequently, blowdown and makeup of these chemicals do not occur. Difficulties, liabilities and expenses associated with the chemical blowdown are eliminated. Chemical makeup difficulties, liabilities and expenses are similarly eliminated when chemical treatment is not necessary.

(g) The invention is mechanically simple. There are no solid moving parts susceptible to failure or requiring maintenance. Operational difficulties and expenses are minimal.

(h) The invention incorporates no solid wall heat transfer. Accordingly, there are no ancillary mechanical requirements such as heat transfer wall thickness, thermal conductivity, abrasion resistance or corrosion resistance. The invention can be made of inexpensive, easy to fabricate, corrosion resistant materials such as plastic.

(i) Operation of the invention is not impaired by the presence of precipitating and accumulating solids in a saturated liquid solution. Consequently, blowdown of the saturated liquid and makeup with unsaturated or fresh liquid to maintain operations below saturation is not necessary. Difficulties, environmental liabilities and expenses associated with the blowdown volume and/or constituents are eliminated. Makeup difficulties, environmental liabilities and expenses are similarly eliminated when liquid makeup is not necessary.

(j) The invention has the capability to transfer heat into a scaling, fouling, saturated liquid without blowdown and makeup requirements. This capability eliminates the need for monitoring of the liquid characteristics and associated blowdown and/or makeup controllers. The capital and operating expense for this monitoring and control equipment is eliminated. The risk of malfunction of such monitoring and control equipment and the liabilities that such a failure could provoke are eliminated.

(k) The invention provides all the advantages of direct contact immiscible heat transfer without the limitations incited by dispersed droplet agglomeration. Heat transfer rates are similar to that of direct contact immiscible heat transfer in the presence of surface area generating dispersion trays or plates without the difficulties normally associated with plugging, fouling and/or scaling of such trays or plates.

(l) The invention requires much less mechanical energy for operation than submerged combustion direct contact heating processes. The direct contact heat transfer process of the invention employs direct contact between the liquid to be heated and an immiscible heat transfer fluid. A droplet of heat transfer fluid, as used in the invention, has a much higher thermal content and thermal conductivity than a bubble of hot gas as is used in the submerged flame combustion processes. Consequently the invention requires a contacting time and volume much less than that required for submerged flame combustion. The contacting column height and required pumping pressures are accordingly reduced. The mechanical pumping power requirement of the invention is much lower than that of submerged flame combustion because of reduced pressure, lower volumes and fluid incompressibility.

(m) The invention requires no pollution control equipment since carryover in a vapor stream above the heated liquid does not occur. Disengagement occurs in a smooth laminar flow with no aggressive turbulence or bubbling at the heated fluid surface. Without surface emissions there is no pollution control equipment needed. Associated capital and maintenance costs, are eliminated. The invention does not incur operational problems and liabilities resulting from inoperable pollution control equipment.

(n) The invention can utilize low temperature heat sources. The direct contact process of the invention provides for maximum heat transfer. The high thermal conductivities, active convection and thermal capacity of the contacting fluid permits high heat transfer rates even with low temperature differentials. This characteristic permits successful heat transfer operation of the invention with low grade heat sources. Low temperature, waste heat can be employed for advantageous use. Low temperature waste heat is inexpensive and often available for free.

(o) The direct contact immiscible heat transfer process employed in the invention involves no phase changes or other chemical processes. The constituents of the heated liquid are not affected by chemical byproducts generated in the heating process.

(p) Heat transfer is a nonturbulent process in the invention. Thermally generated precipitates and solids easily settle and are carried from the process without operational intervention. In the invention, solids removal is a continuous process rather than a batch process. Submerged flame direct contact heat transfer processes typically operate in a batch cycle. This is a disadvantage of submerged flame operations. Continuous removal eliminates the difficulties and expenses associated with the shutdown and startup operations required by batch processes.

(q) The direct contact heating process of the invention is closed and, unlike steam injection, does not induce contamination of the liquid. There is no requirement for disposal, discharge or blowdown of condensates or other byproducts of the heat transfer process.

(r) The invention provides a heat transfer process which is energy efficient and insensitive to the turbidity, and other properties which are essential to successful radiative transfer processes.

(s) The invention provides a nonscaling and fouling resistant heat transfer process which is much less expensive, not limited in size or configuration and much more energy efficient than microwave radiative heat transfer processes.

DRAWING FIGURES

FIG. 1 is a process diagram of the invention.

REFERENCE NUMERALS IN THE DRAWING

1 Warm, Immiscible Heat Transfer Fluid (HTF) introduced to the invention

2 Dispersion mechanism to introduce the warmed HTF into the invention as a noncontinuous droplet phase

3 Dispersed droplets of HTF being buoyed upward

4 Contacting Chamber

5 Liquid to be heated

6 Agglomerating HTF droplets

7 HTF wetted, free-floating, semi-buoyant media bed

8 Cooled, continuous phase of HTF

9 HTF disengagement area

10 Cool HTF from invention

11 Liquid Disengagement Area

12 Warmed liquid from invention

BRIEF SUMMARY OF THE INVENTION

The intent of this patent is to describe a process for the efficient transference of heat into (or out of) a liquid. The process incorporates the introduction of a warmed (or cooled) immiscible heat transfer fluid, referred hereafter as "HTF", in direct contact to a liquid, referred hereafter as "the liquid" in the presence of a surface active, free floating, semi-buoyant media. Direct contact between the HTF and the liquid optimize heat transfer by means of the elimination of thermally interfering material and the insurance of maximum thermal gradients. Direct contact further promotes heat transfer into or out of the liquid by the elimination of solid wall heat transfer sites which would otherwise be susceptible to the insulating effects of plugging, scaling and/or fouling or mechanical damage due to corrosion. The presence of the surface active, free floating, semi-buoyant media provides a means for the maintenance of adequate direct contacting surface area. The free floating, semi-buoyant nature of the surface active media induces a self cleaning agitation of the media.

Heat transfer in the invention occurs through intimate direct contact between a dispersed phase of either the HTF or the liquid and a continuous phase of the other. The dispersed phase droplets have an inherent tendency toward agglomeration into larger droplets as the two phases contact. Heat transfer between the phases is impeded as a consequence of the lesser surface area provided by the larger droplets. To counteract this tendency, a free-floating, semi-buoyant, surface active media is maintained at a location within the contacting phases where agglomeration effects become pronounced. The surface properties of this semi-buoyant media are so chosen as to be preferentially wetted by the dispersed phase of the contacting HTF and liquid. As the enlarging, dispersed phase droplets contact the media, the wetting property compels the spread of the droplet liquid over the media effecting a high surface area film. The surface area generated from this film compensates for that lost due to droplet agglomeration.

The introduced HTF is so chosen that, in addition to immiscibility, the HTF and the liquid are of differing densities. This density difference provides the impetus for the relative motion of the dispersed and continuous phases past each other. The less dense fluid being buoyed upward relative to the more dense fluid. The differing densities also provide the mechanism for the semi-buoyancy of the surface active media. The effective density of this media being so chosen as to be intermediate between that of the dispersed and continuous phases. An effect of this intermediate density is that the media will float in the denser phase and sink in the less dense phase. In the presence of mixed phases, as occurs during the direct contacting process, the media remains free-moving and suspended. During the direct contacting process, localized mixture and corresponding net density variations promote motion in the media. This motion provides for a self cleaning action of the media preventing accumulation of precipitates and other undesirable solids.

Description-FIG. 1

Direct to obtaining the effect of the invention a preferred embodiment is illustrated on FIG. 1 and is described in the following discussion.

A warmed HTF 1 is introduced, by means of a dispersion mechanism 2, as a warmed dispersed droplet phase 3 into the lower section of a contacting chamber 4. A cool, potentially scaling, fouling and/or corrosive liquid 5 is introduced as a continuous phase into the top of the contacting chamber 4. In such an embodiment, the HTF is chosen to be less dense than the liquid. As a result of this density difference the warm HTF rises in a countercurrent fashion through the cool, falling liquid. The dispersed HTF droplet size and the liquid downward velocity are so chosen that the HTF droplet relative velocity upward through the liquid is greater than the downward velocity of the liquid relative to the contacting chamber 4. This is necessary to ensure that the HTF droplets are not carried downward relative to the contacting chamber 4.

The HTF initially rises as a series of droplets 3. As the droplets rise countercurrent to the liquid they transfer heat outward into the liquid in a roughly spherical fashion. The rising droplets tend to aggregate into larger droplets 6. These larger droplets eventually encounter a free-floating, semi-buoyant media bed 7. Upon encountering the media bed 7, the droplets, which have now enlarged to a relatively ineffective size 6, are compelled by the preferential surface wettability of the media 7 to spread over the media surface and flow in a film like manner upward through the media 7. The HTF continues to transfer heat, as a direct contact film type transfer, with the liquid passing countercurrent downward through the media. The HTF eventually rises out of the media bed 7, thermally spent and in a continuous phase 8, into a disengagement collection area 9. In the HTF disengagement collection area 9 there is a relative quiescence amenable to segregation of the HTF from any entrained liquid. From the disengagement collection area 9 the cool HTF is directed away 10 from the invention.

In this embodiment the denser liquid 5 is introduced into the contacting chamber 4 from the top but slightly below the HTF disengagement area 9. The liquid 5 flows downward at a rate controlled to insure a net upward motion of the HTF relative to the contacting chamber 4. The liquid passes downward through the media bed 7 where it is heated through direct contact with the HTF film coating the media surfaces. The liquid exits the media bed 7 and continues downward in countercurrent flow against the rising, dispersed droplets of HTF 6,3. Heat is transferred from these rising droplets in a roughly spherical fashion into the surrounding, downflowing liquid. The liquid eventually passes below the HTF droplet dispersion mechanism 2 and enters the liquid disengagement collection area 11. In the liquid disengagement collection area 11 there is a relative quiescence amenable to segregation of the liquid from any entrained HTF. The heated liquid is then directed away 12 from the invention.

Conclusion, Ramifications, and Scope

The reader will see that the invention provides a simple method to transfer heat into or out of a potentially fouling, scaling or corrosive liquid. In contrast to the prior art the reader will note that the invention transfers heat without the operational and financial burdens of chemical treatments, exotic cleaning mechanism, fluids gain or loss, fluid contamination or environmental pollution concerns and with the use of inexpensive, lightweight, easily fabricated, corrosion resistant materials such as plastics. The advantages over prior art are substantial in that expensive, troublesome, environmentally hazardous and energy inefficient processes can be displaced by the invention. New and novel processes, products or businesses not feasible with the prior art because of fouling, scaling or corrosion related technical or financial difficulties could succeed. The reader will also see that other advantages are inherent to the heat transfer performance and characteristics of the invention. Some of these additional advantages are:

- The invention permits heat transfer into or out of liquids which would otherwise not be technically or financially possible. The heat transfer process of the invention employs no solid wall conduction. Without the presence of solid walls to scale, foul or corrode, technical and financial concerns associated with such issues are eliminated.
- The heat transfer process requires no hazardous or environmentally malevolent chemical additives to prevent fouling, scaling or corrosion. This advantage reduces operational and environmental liabilities. Such benefits reduce business risk, environmental permitting hurdles, pollution control issues and enhances personnel working environments.
- The enhanced thermal gradients of the invention permits the use of lower temperature differentials for heat transfer. The direct contact nature of the heat transfer process maximizes thermal gradients and therefore minimizes the temperature differentials necessary for heat transfer. The use of lower (higher if cooling) thermal source (thermal sink if cooling) temperatures is advantageous in providing the capability to use lower grade, less expensive thermal sources, including waste heat for process heating. (For cooling applications higher temperature, less efficient, generally less expensive thermal sinks or coolers can be employed.)
- The need for continuous or frequent monitoring of the liquid being heated (or cooled) for physical and chemical properties is eliminated. The insensitivity of the invention to scaling, fouling and corrosion eliminates the need and associated expenses for monitoring instrumentation and related equipment for the control of chemical feed, blowdown, makeup or other treatment procedures.
- The invention does not require blowdown of scaling, fouling and/or corrosive liquids and makeup with liquid of lesser scaling, fouling and/or corrosive tendencies is eliminated. The invention can transfer heat unimpeded by the presence of scaling, fouling solids or corrosivity of the liquid. Therefore, environmental liabilities and associated expenses resulting from blowdown of the scaling, fouling and/or corrosive liquids and makeup by less scaling, fouling and/or less corrosive liquid is not required.

The invention can transfer heat with a high thermal approach by means of direct contact without the requirement for plates, trays or rigid packing which is susceptible to plugging, scaling, fouling or corrosion. The invention does this through the employment of a free-floating, semi-buoyant, surface active media devised to increase contacting surface area between the HTF and the liquid being heated or cooled.

High mechanical energy requirements are not needed with the invention to provide the benefits of direct contact heat transfer. The invention employs direct contact heat transfer as effected through direct liquid to liquid contact. The high mechanical energy requirements, as are associated with submerged combustion gas to liquid direct contact heat transfer are avoided. Reduced operating and capital expenses are a consequence.

Demisting and other pollution control equipment are not required with the invention. The direct contacting fluids separate smoothly with no bubbling, splashing or other potentially polluting phenomenon associated with the direct contact heat transfer mechanism of the invention. Environmental liabilities, permitting issues as well as capital and operating costs are minimized.

The heat transfer process of the invention does not require turn down or shut down to facilitate removal of generated or entrained solids. The nature of the direct contact heat transfer process employed by the invention is a gentle, nonturbulent process whereby solids generated by temperature changes associated with heat transfer or are carried into the invention from elsewhere, can separate and be continually removed during operation. The invention transfers heat in a continuous manner, unimpeded by batch process shutdowns. The operational difficulties and expenses associated with shutdowns and startups are eliminated.

The invention transfers heat to the liquid without dilution or contamination. The invention can operate as a closed system not requiring treatment or blowdown for contamination resulting from combustion byproducts, steam or other material injection intended to supply or remove heat. Expenses, difficulties and liabilities associated with treatment or blowdown of diluted or contaminated liquid is eliminated.

The invention can be manufactured of inexpensive, easy to fabricate materials such as plastics. The direct contact heat transfer process of the invention does not employ solid wall heat conduction. This eliminates the requirements for materials of construction requiring high thermal conductivity, mechanical integrity and possibly corrosion resistance. This advantage reduces both material and fabrication expenses.

Heat transfer efficiency of the invention is not dependent upon turbidity, or other parameters of the liquid. In contrast to radiative heat transfer processes the invention does not require the liquid to be opaque, transparent or translucent to any or all electromagnetic wavelengths. This advantage eliminates the need and associated expenses for filtration or other processes and related equipment to maintain adequate liquid quality for efficient heat transfer.

The invention transfers heat unimpeded by the electromagnetic absorption qualities of the liquid. The direct contact heat transfer process of the invention does not require liquid qualities or geometrical configurations necessary for electromagnetic coupling as is required for microwave heating processes. This advantage removes restrictions and related compensating costs to the type of liquids, materials of construction and geometrical configuration of the heat transfer equipment.

While the foregoing discussions specify the many advantages inherent to the invention these do not constitute the full scope of advantages. There are many advantages beyond those defined herein. In a similar manner, the preferred embodiment, described in the foregoing, is not the only embodiment possible. Other embodiments are possible. Some, though not all, examples of other embodiments are as follows:

An embodiment similar to the foregoing but employing a cool HTF to remove heat from a warm, liquid. In such an embodiment the HTF and liquid are introduced, contacted and separated in the same fashion as the foregoing embodiment. The HTF however is introduced cool and separated from the invention warm. The liquid is introduced warm and separated from the invention cool. All internal processes are similar to the previous embodiment, only the heat transfer directions are reversed.

Another embodiment in which the HTF is denser than the liquid is possible. In essence this embodiment is the inverse of the preferred embodiment. In such an embodiment the warmed HTF 1 is introduced by means of a dispersion mechanism 2 as a series of dispersed droplets 3 into the upper section of a contacting chamber 4. The cool liquid 5 is introduced as a continuous phase into the lower section of the contacting chamber 4 flowing upward as a result of externally supplied pressure. As a consequence of the density differential the dispersed HTF sinks in a countercurrent fashion through the rising liquid. The dispersed droplet size and the liquid upward velocity are so chosen that the droplet relative velocity downward through the liquid is greater than the upward velocity of the liquid relative to the contacting chamber 4. This is necessary to ensure that the droplets are not carried upward relative to the contacting chamber 4.

The HTF initially sinks as a series of droplets 3. As the droplets sink countercurrent to the liquid they transfer heat outward into the liquid in a roughly spherical fashion. The sinking droplets tend to aggregate into larger droplets 6. These larger droplets eventually encounter a free-floating, HTF wetted, semi-buoyant suspended media bed 7. Upon encountering the media bed 7, the droplets, which have now enlarged to a relatively ineffective size 6, are compelled by the preferential surface wettability of the media 7 to spread over the media surface and flow in a film like manner downward through the media 7. The HTF continues to transfer heat, as a direct contact film type transfer, with the liquid passing countercurrent upward through the media. The HTF eventually sinks out of the media bed 7, thermally spent and in a continuous phase 8, into a disengagement collection area 9. In the HTF disengagement collection area 9 there is a relative quiescence amenable to segregation of the HTF from any entrained liquid. From the disengagement collection area 9 the HTF is directed away 10 from the invention.

In this embodiment the less dense liquid 5 is introduced into the contacting chamber 4 from the bottom but slightly above the HTF disengagement area 9. The liquid 5 flows upward at a rate controlled to insure a net downward motion of the HTF relative to the contacting chamber 4. The liquid passes upward through the media bed 7 where it is heated through a direct contact film type heat transfer process. The liquid exits the media bed 7 and continues upward in countercurrent flow against the sinking, dispersed droplets of HTF 6,3. Heat is transferred from these sinking droplets in a roughly spherical fashion into the surrounding, upflowing liquid. The liquid eventually passes above the HTF droplet dispersion mechanism 2 and enters the liquid disengagement collection area 11. In the liquid disengagement collection area 11 there is a relative quiescence amenable to segregation of the liquid from any entrained HTF. The heated liquid is then directed away 12 from the invention.

An embodiment similar to the previous one but employing a cool HTF to remove heat from a warm liquid. In such an embodiment the HTF and liquid are introduced, contacted and separated in the same fashion as the previous embodiment. The HTF however is introduced cool and separated from the invention warm. The liquid is introduced warm and separated from the invention cool. All internal processes are similar to the previous embodiment, only the heat transfer directions are reversed.

In the foregoing embodiments the impetus for countercurrent flow and eventual separation of the HTF and the liquid is density differential. Gravity buoys a less dense fluid upward through a more dense fluid. The gravitational driving force can be replaced or enhanced by means of centrifugal force. Embodiments in which centrifugal force is employed to replace or enhance gravity are possible. Such embodiments can be used to accelerate the separation process of the HTF from the liquid. Such embodiments can also enhance the density differential impetus in those circumstances for which the density differential is too small to provide adequate countercurrent flow and/or final separation of the HTF and the liquid.

Direct to obtaining the effect of the invention for heating of a liquid with the employment of centrifugal force for enhancement, acceleration or density differential compensation, a typical embodiment is described a follows:

A warmed HTF 1 is introduced as a warmed dispersed droplet phase 3 in the lower section, tangential to the wall and perpendicular to the axis of a generally cylindrical and/or conical contacting chamber 4. Such introduction induces cyclonic flow in the contacting chamber. The cool liquid 5 is introduced in a swirling or linear fashion into the center of the cyclonic swirl, as a continuous phase, into the top center of the contacting chamber 4. In such an embodiment, the HTF is chosen to be less dense than the liquid. As a result of this density difference the warm HTF tends to rise in the contacting chamber and move radially inward, due to centrifugal forces, relative to the cyclonic flow in the contacting chamber. The HTF moves in a countercurrent fashion through the cool, radially outward moving and falling liquid. The dispersed HTF droplet size, the liquid downward velocity and the cyclonic rotational velocity are so chosen that the HTF droplet relative velocity upward and inward through the liquid is greater than the downward and radially outward velocity of the liquid relative to the contacting chamber 4. This is necessary to ensure that the HTF droplets are not carried downward and radially outward relative to the contacting chamber 4.

The HTF initially rises and moves radially inward as a series of droplets 3. As the droplets move countercurrent to the liquid, they transfer heat into the surrounding liquid in a roughly spherical fashion. The moving droplets tend to aggregate into larger droplets 6. These larger droplets eventually encounter a free-floating, HTF wetted, semi-buoyant media bed 7 buoyed, in an essentially conical configuration, at a certain radial distance inward and vertically upward in the contacting chamber. Upon encountering the media bed 7, the droplets, which have now enlarged to a relatively ineffective size 6, are compelled by the preferential surface wettability of the media 7 to spread over the media surface and flow in a film like manner upward and radially inward through the media 7. The HTF continues to transfer heat, as a direct contact film type transfer, into the liquid passing countercurrent downward and radially outward through the media. The HTF eventually exits radially inward and upward from the media bed 7, thermally spent and in a continuous phase 8, into a disengagement collection area 9. In the HTF disengagement collection area 9 there is a relative quiescence amenable to segregation of the HTF from any entrained liquid. From the disengagement collection area 9 the cool HTF is directed away 10 from the invention.

In this embodiment the more denser liquid 5 is introduced into the contacting chamber 4 from the top center but slightly below the HTF disengagement area 9. The liquid 5 flows downward and radially outward at a rate controlled to insure a net upward and radially inward motion of the HTF relative to the contacting chamber 4. The liquid passes downward and radially outward through the media bed 7 where it is heated through a direct contact film type heat transfer process. The liquid exits the media bed 7 and continues downward and radially outward in countercurrent flow against the rising and radially inward moving dispersed droplets of HTF 6,3. Heat is transferred from the dispersed droplets in a roughly spherical fashion into the surrounding, down and radially outflowing liquid. The liquid eventually passes below the HTF droplet dispersion mechanism 2 and enters the liquid disengagement collection area 11. In the liquid disengagement collection area 11 there is a relative quiescence amenable to segregation of the liquid from any entrained HTF. The heated liquid is then directed away 12 from the invention.

An embodiment similar to the previous one but employing a cool HTF to remove heat from a warm liquid. In such an embodiment the HTF and liquid are introduced, contacted and separated in the same fashion as the previous embodiment. The HTF however is introduced cool and separated from the invention warm. The liquid is introduced warm and separated from the invention cool. All internal processes are similar to the previous embodiment, only the heat transfer directions are reversed.

Another embodiment which employs centrifugal force for enhancement, process acceleration or density differential compensation and for which a heated but more dense HTF is employed to transfer heat into a cool, but less dense, liquid is described a follows:

A cool liquid 5 is introduced, under pressure, as a continuous phase, into the lower section, tangential to the wall and perpendicular to the axis of a generally cylindrical and/or conical contacting chamber 4. Such introduction induces cyclonic flow in the contacting chamber. A warm HTF 1 is introduced as a warm dispersed droplet phase 3 in a swirling or linear fashion into the center of the cyclonic flow at the top center of the contacting chamber 4. In such an embodiment, the HTF is chosen to be more dense than the liquid. As a result of this density difference, the warm HTF tends to sink and, due to centrifugal forces, move radially outward in the contacting chamber. The HTF moves in a countercurrent fashion through the cool rising and radially inward moving liquid. The dispersed HTF droplet size, the liquid upward velocity and the cyclonic rotational velocity are so chosen that the HTF droplet relative velocity downward and radially outward through the liquid is greater than the upward and radially inward velocity of the liquid relative to the contacting chamber 4. This is necessary to ensure that the HTF droplets are not carried upward and/or radially inward relative to the contacting chamber 4.

The HTF initially sinks and moves radially outward as a series of droplets 3. As the droplets move countercurrent to the liquid they transfer heat into the surrounding liquid in a roughly spherical fashion. The moving droplets tend to aggregate into larger droplets 6. These larger droplets eventually encounter a free-floating, HTF wetted, semi-buoyant media bed 7 buoyed, in an essentially conical configuration, at a certain radial distance outward and vertically downward in the contacting chamber. Upon encountering the media bed 7, the droplets, which have now enlarged to a relatively ineffective size 6, are compelled by the preferential surface wettability of the media 7 to spread over the media surface and flow in a film like manner downward and radially outward through the media 7. The HTF continues to transfer heat, as a direct contact film type transfer, into the liquid passing countercurrent upward and radially inward through the media. The HTF eventually exits radially outward and downward from the media bed 7, thermally spent and in a continuous phase 8, into a disengagement collection area 9. In the HTF disengagement collection area 9 there is a relative quiescence amenable to segregation of the HTF from any entrained liquid. From the disengagement collection area 9 the cool HTF is directed away 10 from the invention.

In this embodiment the less dense liquid 5 is introduced, under pressure, tangentially into the lower section of the contacting chamber 4. In a cyclonic upward spiral the liquid 5 flows upward and radially inward at a rate controlled to insure a net upward and radially inward motion of the liquid relative to the contacting chamber 4. The liquid passes upward and radially inward through the media bed 7 where it is heated through a direct contact film type heat transfer process. The liquid exits the media bed 7 and continues upward and radially inward in a countercurrent flow against the sinking and radially outward moving dispersed droplets of HTF 6,3. Heat is transferred from the dispersed droplets in a roughly spherical fashion into the surrounding, rising and radially inflowing liquid. The liquid eventually passes above the HTF droplet dispersion mechanism 2 and enters the liquid disengagement collection area 11. In the liquid disengagement collection area 11 there is a relative quiescence amenable to segregation of the liquid from any entrained HTF. The heated liquid is then directed away 12 from the invention.

An embodiment similar to the previous one but employing a cool HTF to remove heat from a warm liquid is possible. In such an embodiment, the HTF and liquid are introduced, contacted and separated in the same fashion as the previous embodiment. The HTF however is introduced cool and separated warm from the invention. The liquid is introduced warm and separated cool from the invention. All internal processes are similar to the previous embodiment, only the heat transfer directions are reversed.

There are other embodiments possible for the invention utilizing centrifugal force for the enhancement, process acceleration or density differential compensation. Embodiments in which the contacting chamber is rotated to generate higher gravitational effects can be visualized in different formats. Such embodiments could use configurations similar to those as discussed in the foregoing but would use centrifugal force acting upon all or part of the invention to magnify the force and effects of gravity on the density differential impetus driving the countercurrent flow and eventual segregation of the HTF and the liquid being heated or cooled.

An embodiment can be employed in which the HTF, or the liquid, is introduced in such a fashion that the volume ratio of HTF to liquid in the mixture varies within the media bed. An example of such a configuration is the introduction of HTF 1 through a dispersion mechanism 2 which introduces the dispersed droplets of HTF 3 in a nonuniform pattern into the lower section of the contacting chamber 4. The resulting nonuniform mixture passes through and provides a nonuniform mixture environment within the media bed.

The net density of the HTF and liquid mixture is determined not only by the densities of the HTF and the liquid but also by their proportionate ratios in the mixture. As an example, a mixture that is 50% HTF and 50% liquid will have a net density halfway between that of the liquid and that of the HTF. A mixture that is 75% liquid and 25% HTF will have an effective density 75% between that of the HTF and that of the liquid. A nonuniform net density environment within the media bed results from the nonuniform mixture environment within the media bed.

The media has a density intermediate between that of the liquid and that of the HTF. As a consequence, the media will float on top in the denser one but sink to the bottom in the less dense one. In an environment of varying net mixture densities the media will move downward in locales of lower net density and upward in locales of higher net density. The nonuniform net density environment within the media bed generate locales of higher and lower net densities within the media bed. These locales provide the impetus for the media to circulate, downward in the lower net density locales and upward in the more dense locales. As the media circulates, internal abrasion provides a self-cleaning mechanism for the media. An advantage of such an embodiment is the enhanced ability of the invention to transfer heat in liquids that contain exceptionally high suspended solids or for which precipitating solids are severe without the possibility of plugging.

What is claimed is:

1. A process for heating or cooling a liquid or a fluid by contacting the liquid with an immiscible fluid, having a different temperature, in the presence of a heat transfer enhancing media bed, the media bed received inside a contacting chamber, the steps comprising:

introducing the fluid into the chamber and introducing the fluid in the media bed with the fluid wetting the media bed and forming a surface film thereon, the median bed being surface active, free floating in the chamber and buoyant;

introducing the liquid into the chamber;

contacting the surface film on the media bed with the liquid, whereby the surface film provides for maximum contact and heat exchange between the liquid and fluid; and removing the fluid and the liquid from the chamber.

2. The process as described in claim 1 wherein said fluid is introduced into the chamber below the media bed and the liquid is introduced into the chamber above the media bed, the fluid having a density less than the density of the liquid.

3. The process as described in claim 1 wherein said fluid is introduced into the chamber above the media bed and the liquid is introduced into the chamber below the media bed, the fluid having a density greater than the density of the liquid.

4. The process as described in claim 1 wherein the fluid is in introduced in a cyclonic flow in the chamber and the liquid is introduced into a center of the cyclonic flow of the fluid in the chamber.

5. The process as described in claim 1 wherein the fluid is introduced into the chamber instigating a density differential driven convection in the chamber for enhancing self cleaning of the media bed.

6. The process as described in claim 1 wherein the fluid is introduced into the chamber warm and removed from the chamber cool, the liquid introduced into the chamber cool and removed from the chamber warm.

7. The process as described in claim 1 wherein the fluid is introduced into the chamber cool and removed from the chamber warm, the liquid introduced into the chamber warm and removed from the chamber cool.

8. A process for heating or cooling a liquid by contacting the liquid with an immiscible fluid, having a different temperature and density, in the presence of a heat transfer enhancing media bed, the media bed received inside a contacting chamber, the steps comprising:

introducing the fluid into the chamber and below the media bed and raising the fluid upwardly through the media bed with the fluid wetting the media bed and forming a surface film thereon, the median bed being surface active, free floating in the chamber and buoyant;

introducing the liquid in a countercurrent direction from the fluid into the chamber and above the media bed and allowing the liquid to sink downwardly;

contacting the surface film on the media bed with the liquid, whereby the surface film provides for maximum contact and heat exchange between the liquid and fluid; and removing the fluid from the chamber above the media bed and removing the liquid from the chamber below the media bed.

9. The process as described in claim 8 wherein the media bed is made of a material which has an intermediate density between the density of the fluid and the density of the liquid.

10. The process as described in claim 8 wherein the media bed is buoyant wherein by means of a density differential between the liquid and the fluid, the fluid is buoyant and is driven upwardly in the chamber and the liquid sinks and is driven downwardly in the chamber past each other in a direct counterflowing manner.

11. The process as described in claim 8 wherein the fluid and the liquid are continuously introduced into the chamber for providing a continuous heat transfer between the fluid and the liquid using the fluid preferentially wetting the surface of the media bed.

12. The process as described in claim 8 wherein the fluid is introduced into the chamber instigating a density differential driven convection in the chamber for enhancing self cleaning of the media bed.

13. The process as described in claim 8 wherein the fluid is in introduced in a cyclonic flow in the chamber and the liquid is introduced into a center of the cyclonic flow of the fluid in the chamber.

14. A process for heating or cooling a liquid by contacting the liquid with an immiscible fluid, having a different temperature and density, in the presence of a heat transfer enhancing media bed, the media bed received inside a contacting chamber, the steps comprising:

introducing the fluid into the chamber and above the media bed and lowering the fluid downwardly through the media bed with the fluid wetting the media bed and forming a surface film thereon, the median bed being surface active, free floating in the chamber and buoyant;

introducing the liquid in a countercurrent direction from the fluid into the chamber and below the media bed and allowing the liquid to rise upwardly;

contacting the surface film on the media bed with the liquid, whereby the surface film provides for maximum contact and heat exchange between the liquid and fluid; and removing the fluid from the chamber below the media bed and removing the liquid from the chamber above the media bed.

15. The process as described in claim 14 wherein the media bed is made of a material which has an intermediate density between the density of the fluid and the density of the liquid.

16. The process as described in claim 14 wherein the media bed is buoyant from a density differential wherein the fluid is driven downwardly in the chamber and the liquid is driven upwardly in the chamber past each other in a direct counterflowing manner.

17. The process as described in claim 14 wherein the fluid is introduced at a substantially continuous rate into the chamber below the media bed, wherein the liquid is introduced at a substantially continuous rate above the media bed, wherein the liquid downward velocity in the chamber is designed to be less than the upward velocity of the fluid.

18. The process as described in claim 14 wherein the fluid is in introduced in a cyclonic flow in the chamber and the liquid is introduced into a center of the cyclonic flow of the fluid in the chamber.

* * * * *